United States Patent [19]

Buonassissi

[11] Patent Number: 4,601,067

[45] Date of Patent: Jul. 22, 1986

[54] VEST

[76] Inventor: Mark Buonassissi, 6128 N. Eastbrook St., Lakewood, Calif. 90712

[21] Appl. No.: 732,553

[22] Filed: May 10, 1985

[51] Int. Cl.[4] ..... A41D 1/04; A41D 1/00; A41D 13/00; F41H 1/02

[52] U.S. Cl. ..... 2/102; 2/94; 2/2.5

[58] Field of Search ..... 2/102, 94, 2, 2.5

[56] References Cited

U.S. PATENT DOCUMENTS

| | | | |
|---|---|---|---|
| 2,620,479 | 12/1952 | Buck | 2/102 |
| 3,997,982 | 12/1976 | Holland | 2/102 |
| 4,241,459 | 12/1980 | Quayle | 2/102 |

*Primary Examiner*—Doris L. Troutman

[57] ABSTRACT

A vest structure having a back panel connected to the upper portions of a left front panel and a right front panel, each of said panels being provided with inside pockets to receive cool or warm packs, and fastening means to provide a close fit of the vest structure around a person's torso.

3 Claims, 5 Drawing Figures

VEST

SUMMARY OF INVENTION

This invention relates to a garment in the shape of a vest having a back panel and two front panels, each equipped with inner inside pockets formed to receive cool packs for cooling a person during hot weather, or to receive warm packs for warming a person during cool weather, and fastening means to maintain the vest in close fit around a person's torso.

Prior art patents such as U.S. Pat. Nos. 1,520,962 (North), 2,648,325 (Siple), 4,268,917 (Massey), and 4,344,620 (Debski), disclosed various vest-like devices with complicated components, such as tubing and wetting, and the like, for cooling or warming purposes.

None of these references discloses the simplified structure and effective capability of the present invention together with its ease of wearing and comfort in wearing.

It is, therefore, an object of this invention to provide a vest structure capable of receiving cool or warm packs to keep a person's torso and the person comfortable in hot or cool weather.

Another object of this invention is to provide a vest structure having cooling or warming capability and which is relatively easy to put on and comfortable to wear.

A further object of this invention is to provide a vest structure having cooling or warming capability which is relatively light weight and inexpensive to manufacture.

These and other objects will be more fully understood by reference to the following description and accompanying drawings, in which FIG. 1 is a front elevational view of the invention, illustrating a preferred embodiment with the front panels shown in closed relationship.

Figure 1:
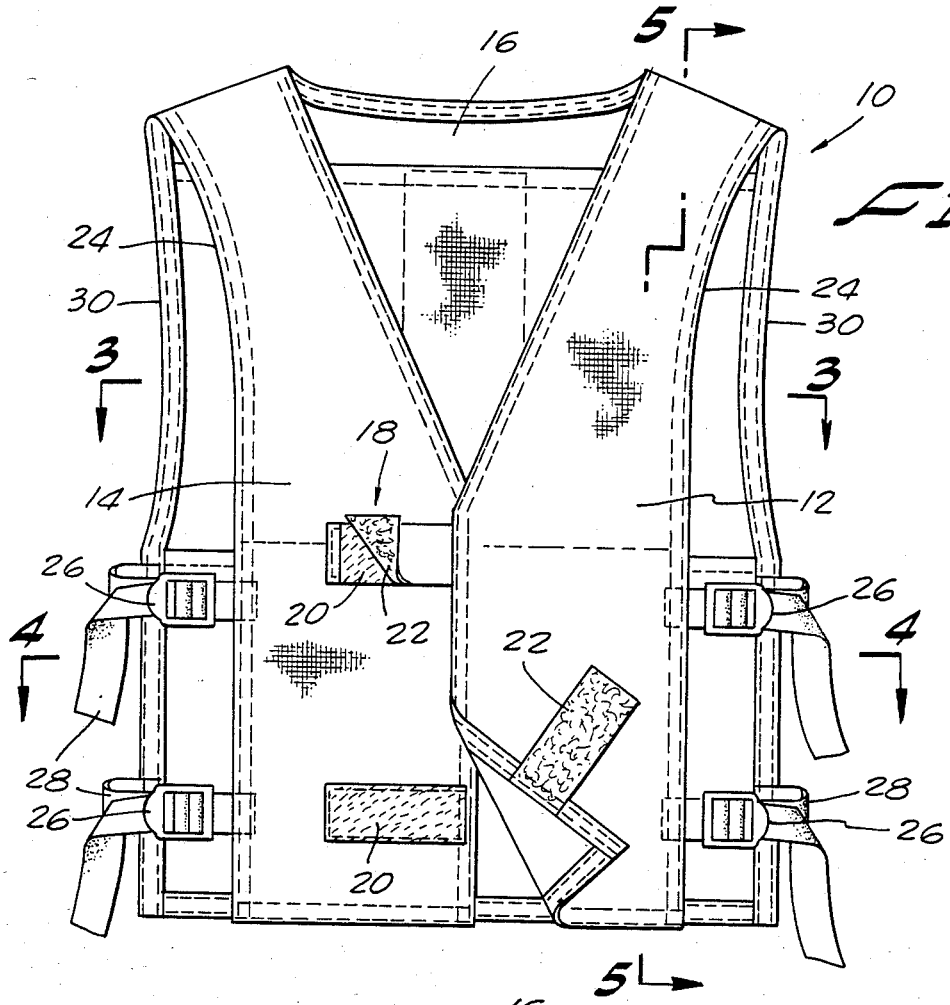
Figure 3:
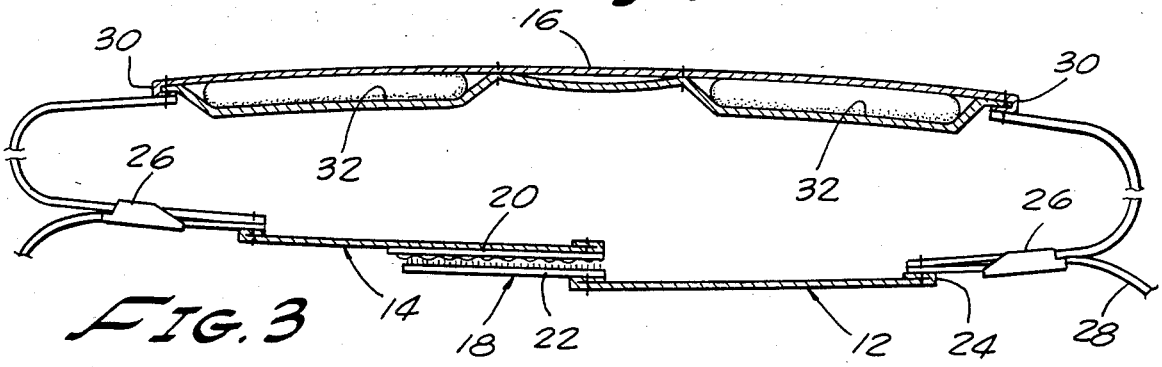
FIG. 3 is a horizontal cross sectional view taken on lines 3—3 of FIG. 1.
Figure 4:
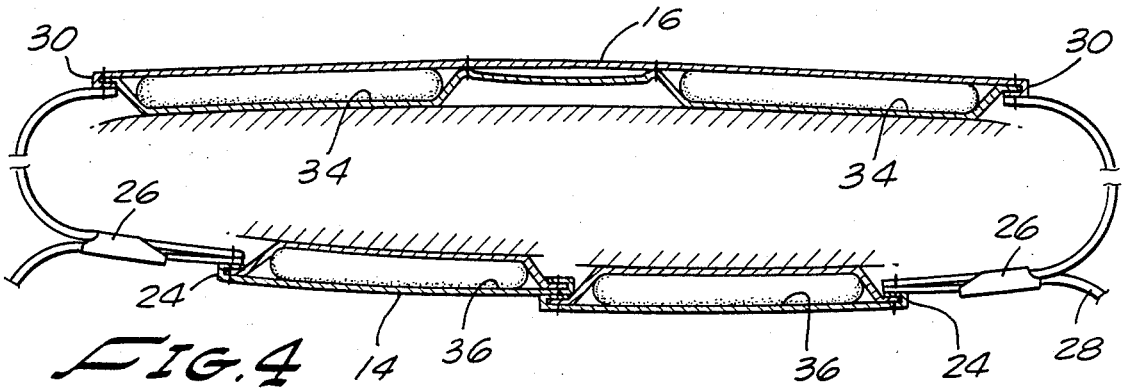
FIG. 4 is a horizontal cross sectional view taken on lines 4—4 of FIG. 2.
Figure 5:
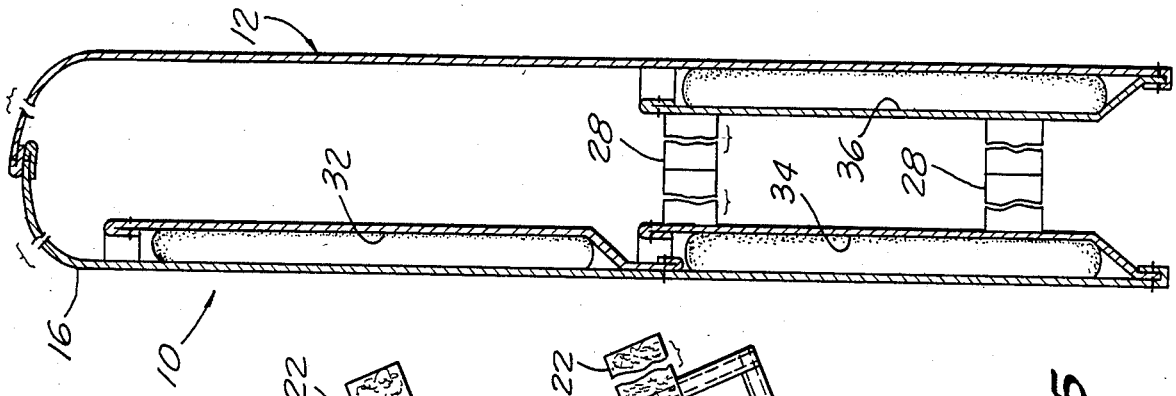
FIG. 5 is a vertical cross sectional view taken on lines 5—5 of FIG. 2.
Figure 2:
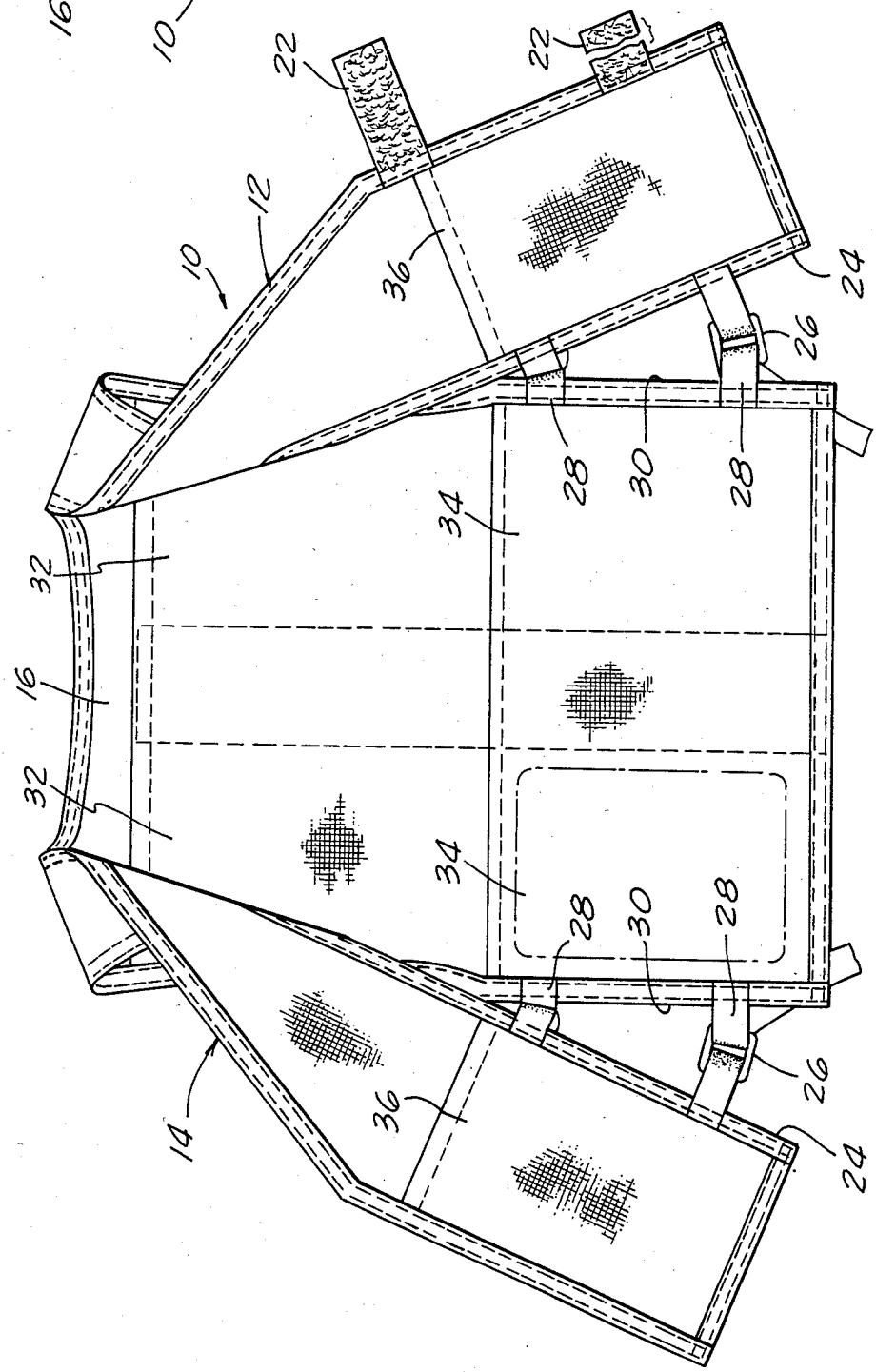
FIG. 2 is a front elevational view of the invention, showing a preferred embodiment with the front panels in open relationship.

The vest 10 has a left front panel 12 and a right front panel 14, both connected at their upper ends to a back panel 16. The front panels 12 and 14 are shaped at their upper inner edges to form a V-neck opening for a person's neck and head.

Any suitable material may be used for the front and back panels, such as that similar to 200 dernier nylon, which is preferred.

The two front panels 12 and 14 are kept in closed position by one or more velcro fasteners 18, preferably two in number, with the hook tape portion 20 secured to right front panel 14 and the pile and loop tape portion 22 secured at its inner end to the inner vertical edge of left front panel 12.

The outer vertical edges 24 of front panels 12 and 14 are each provided with one or more, preferably two spaced apart, adjustable buckles 26 secured thereon by any suitable means and corresponding with one or more belt panels 28 secured by any suitable means to each of the outer vertical edges 30 of back panel 16.

The inner side of back panel 16 is provided with a plurality of inside back pockets, preferably 4 in number, comprising two upper pockets 32 and two lower pockets 34. The back pockets 32 and 34 are preferably formed in a size to occupy substantially all of the inner surface of back panels 16.

The inner surfaces of the lower portions of left and right front panels 12 and 14 are each provided with a pocket 36 extending preferably over substantially the full width of the lower portion of each panel.

Any suitable material may be used for the pockets 32, 34, and 36, having characteristics similar to medium weight white polypress, which is preferable.

In operation, a person determines whether cooling or heating is desired, and procures a plurality of water tight cool packs or hot packs, not shown.

The packs are inserted into the pockets 32, 34, and 36. The person then puts on the vest 10, fastens the velcro fasterners 18, and adjusts the buckles 26 and panels 28 to snug fit around his torso.

In this manner, with suitably internally baffled cool packs, cooling will be provided for a minimum of four hours in temperatures ranging up to 110° Fahrenheit.

Conversely, if warmth is desired, a plurality of suitable warm packs are inserted in the pockets 32, 34, and 36, to keep the wearer warm as desired.

Although I have described by invention in detail with reference to the accompanying drawings illustrating a preferred embodiment of my invention, it is understood that numerous changes in the details of construction and arrangement of parts may be made without departing from the spirit and scope of the invention as hereinafter claimed.

I claim:

1. A vest having cooling or warming capability as desired for a person's torso by using cold packs or warm packs, comprising:

a back panel;

a plurality of inside pockets extending over the inner surface of said back panel;

an inside pocket formed in the inner surface of a left front panel and an inside pocket formed in the inner surface of a right front panel, each of said front panels being connected at their respective upper ends to said back panel;

fastening means to provide a close fit of the vest around a person's torso, whereby a person may be cooled or warmed upon insertion of a plurality of cool packs or warm packs in said pockets.

2. A vest according to claim 1 in which the fastening means comprises VELCRO fasteners for fastening said front panels together.

3. A vest according to claim 1 in which the fastening means comprises a plurality of belt buckles and belt panels for fastening said back panel to the outer edges of said front panels.

* * * * *